US007780840B2

(12) United States Patent
Pearson et al.

(10) Patent No.: US 7,780,840 B2
(45) Date of Patent: Aug. 24, 2010

(54) PROCESS FOR PLATING CHROMIUM FROM A TRIVALENT CHROMIUM PLATING BATH

(76) Inventors: Trevor Pearson, 8, Cricketers Meadow, Cradeley Heath, West Midlands (GB) B64 7HR; Stacey Handy, 41 Barbrook Drive, Brierley Hill, West Midlands (GB) DY5 3PZ ( * ) Notice: Subject to any disclaimer, the term of this patent is extended or adjusted under 35 U.S.C. 154(b) by 0 days.

(21) Appl. No.: 12/261,352

(22) Filed: Oct. 30, 2008

(65) Prior Publication Data

US 2010/0108532 A1 May 6, 2010

(51) Int. Cl.
*C25D 3/06* (2006.01)

(52) U.S. Cl. ..... 205/287

(58) Field of Classification Search ..... 427/430.1; 205/287

See application file for complete search history.

(56) References Cited

U.S. PATENT DOCUMENTS 3,932,198 A 1/1976 Schneider ..... 148/6.2
3,954,574 A * 5/1976 Gyllenspetz et al. ..... 205/243
4,056,449 A 11/1977 de Nora et al. ..... 204/106
4,141,803 A 2/1979 Barclay et al. ..... 204/51
4,359,345 A * 11/1982 Da Fonte, Jr. ..... 148/266
4,374,007 A 2/1983 Barclay et al. ..... 204/51
4,417,955 A 11/1983 Barclay et al. ..... 204/43 R
4,448,649 A 5/1984 Barclay et al. ..... 204/51
4,472,250 A 9/1984 Barclay et al. ..... 204/51
4,473,448 A 9/1984 Deeman ..... 204/51
4,502,927 A 3/1985 Barclay et al. ..... 204/51
4,507,175 A 3/1985 Le Goff ..... 203/27
5,560,815 A * 10/1996 Sekimoto et al. ..... 205/284

FOREIGN PATENT DOCUMENTS

GB 1 602 404 11/1981

* cited by examiner

*Primary Examiner*—Edna Wong
(74) *Attorney, Agent, or Firm*—Carmody & Torrance LLP

(57) ABSTRACT

A plating process for plating chromium metal onto substrates is disclosed. The process uses a trivalent chromium plating bath with a sulfate and/or sulfonate matrix. The process also utilizes insoluble anodes. An addition of manganese ions to the plating bath inhibits the formation of detrimental hexavalent chromium ions upon use of the plating bath.

5 Claims, 1 Drawing Sheet

Figure I
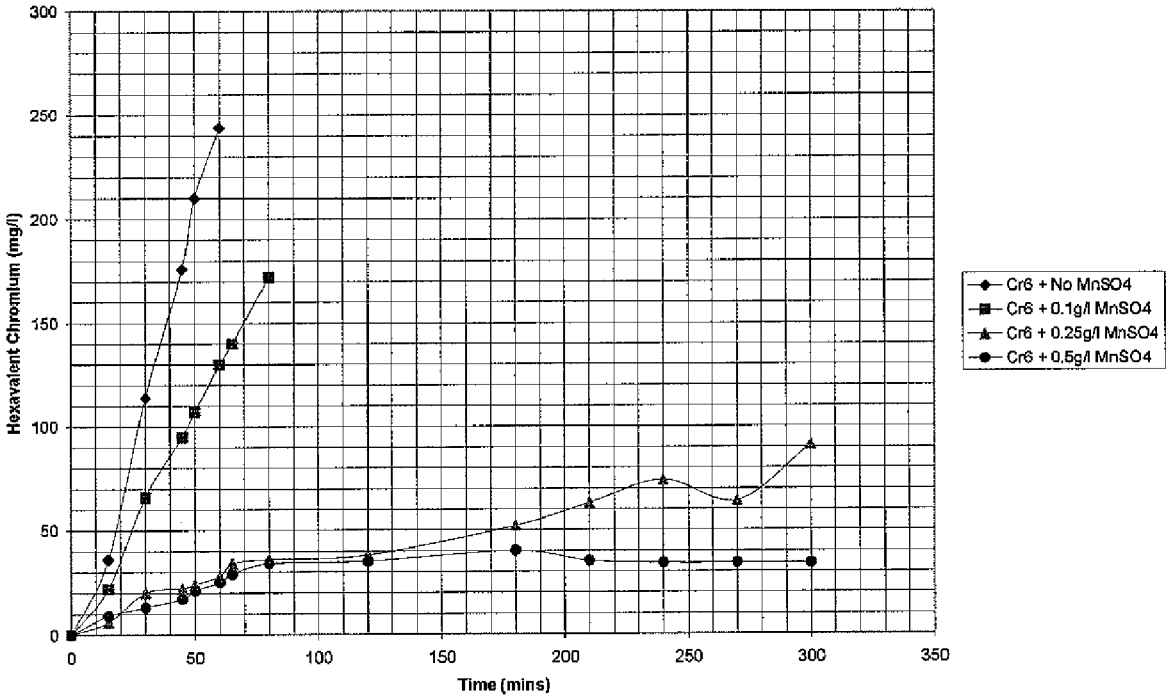

PROCESS FOR PLATING CHROMIUM FROM A TRIVALENT CHROMIUM PLATING BATH

FIELD OF THE INVENTION

The present invention relates to a chromium plating method which utilizes trivalent chromium ions in the plating bath and insoluble anodes. An additive is proposed for the plating bath which will minimize the creation of hexavalent chromium ions at the anode while the plating bath is being used.

BACKGROUND OF THE INVENTION

Trivalent chromium based electrolytes have been in use industrially now for many years since the late 1970s. These processes have advantages over those based on hexavalent chromium in terms of health and safety and toxicity to the environment. However, selection of suitable anodes for these trivalent processes can present significant problems. Insoluble anodes have to be used since the cathode efficiency of the process is very low. The low cathode efficiency would cause a build up of chromium metal in the bath if soluble anodes made of chromium were used. Also, chromium is passive in the electrolyte until an anodic potential sufficient to dissolve the chromium as Cr(VI) is reached. This means that chromium would dissolve in a hexavalent rather than trivalent form if chromium metal anodes were used. Hexavalent chromium is a serious contaminant in trivalent processes and it is important to prevent the formation of this species. Historically, there have been several approaches to this problem: Chloride based electrolytes (where chlorine evolution from insoluble anodes may also be a problem) use bromide ions to catalyse anodic oxidation of chemical species such as formate ions or ammonium ions rather than oxidation of chromium (III) to chromium(VI) (for example see U.S. Pat. No. 3,954,574).

Due to the type of additives used in sulfate based trivalent processes, this strategy cannot be used. In sulfate based processes, there are two possible methods of preventing chromium oxidation. Originally, a divided cell arrangement was used with these processes (for example UK Patent No. 1,602,404). Typically, a lead anode was used in a sulfuric acid anolyte which was separated from the plating bath with a permeable membrane. The plating current was carried by hydrogen cations through a cation permeable membrane. This effectively prevented any contact of trivalent chromium with the surface of the anode, thus preventing oxidation of trivalent to hexavalent chromium. However, this type of arrangement was expensive and difficult to maintain. Also, the membrane had a limited lifespan resulting in unfavourable costs. A later development in trivalent chromium electroplating technology from sulfate based electrolytes utilised iridium/tantalum oxide coated anodes (for example see U.S. Pat. No. 5,560,815). These were used directly in the trivalent chromium solution and the surface of these anodes was found to have a low oxygen over potential (thus facilitating oxygen liberation at the lowest possible anode potentials). However, over a period of operation, the oxidation of trivalent to hexavalent chromium on these anodes was facilitated. Because of the problems outlined above, there remains a need for a suitable cost effective anode for sulfate based trivalent chromium plating processes.

SUMMARY OF THE INVENTION

The inventors herein propose a process for plating chromium metal onto a substrate, said process comprising contacting the substrate with a plating bath comprising:

(a) trivalent chromium ions;
(b) sulfate ions and/or sulfonate ions; and
(c) manganese ions;

wherein the substrate is made the cathode and insoluble anodes comprising a surface coating comprising iridium oxide, ruthenium oxide, and/or platinum are used.

The anodes used in this invention may be placed directly in the plating bath or may be separated from the plating bath in a compartment using a semi-permeable membrane as the separator. It is preferable, however, from cost and efficiency perspectives for the anodes to be placed directly in the plating bath.

BRIEF DESCRIPTION OF THE FIGURES

FIG. 1—The effect of manganese on the hexavalent chromium in a trivalent chromium plating bath.

DETAILED DESCRIPTION OF THE INVENTION

The inventors herein have discovered that the addition of manganese ions to trivalent plating baths which use insoluble anodes can substantially improve the performance of the process and increase the lifetime of the anodes by a large margin. Non-limiting examples of the types of electrolytes useful in plating baths of this invention are given in U.S. Pat. Nos. 4,141,803; 4,374,007; 4,417,955; 4,448,649; 4,472,250; 4,507,175; 4,502,927; and 4,473,448. The amount of manganese ions added to the bath is preferably at least 10 ppm and can be up to the limit of solubility. However, in practice, we have found that large amounts of manganese (more than 700 ppm) co-deposit at the cathode to an unacceptable degree and cause problems with the cosmetic appearance and corrosion performance of the chromium deposited thereon. Therefore, the preferred amount of manganese ions added is within the range of 10 to 700 ppm and more preferably from 100 to 300 ppm. The manganese ions may be added as any suitable bath soluble salt. Manganese sulfate is the preferred salt because the sulfate anion is compatible with the composition of the plating bath.

Without wishing to be bound by theory, we consider that manganese (II) ions are oxidised to manganese dioxide at a lower potential than the oxidation potential of the chromium (III)/chromium(VI) reaction, thus forming a manganese dioxide coating on the surface of the insoluble anodes. The manganese dioxide coated anodes then operate by either facilitating oxygen evolution and/or inhibiting chromium oxidation. When the current is switched off, the manganese dioxide gradually re-forms manganese (II) ions and liberates oxygen. When the current is re-applied, the manganese dioxide coating re-forms on the anode. Thus the addition of a small amount of manganese ions to the plating bath prevents formation of excessive amounts of hexavalent chromium.

As a result, the inventors propose a process for plating chromium metal onto a substrate, said process comprising contacting the substrate with a plating bath comprising:

(a) trivalent chromium ions;
(b) sulfate and/or sulfonate ions;
(c) manganese ions;

wherein the substrate is made the cathode and insoluble anodes are used.

The source of trivalent chromium ions can be any soluble source of trivalent chromium ions. Preferably chrome (III) sulfate is used. However chromium III chloride, chromium (iii) oxylate, chromium (III) carbonate, chromium (III) hydroxide and other similar trivalent chromium ion salts or complexes can be used. The concentration of trivalent chromium ions in the plating bath is preferably from 5 to 40 g/l, most preferably from 10 to 15 g/l. Hexavalent chromium ions are detrimental to the proper working of the plating bath and as a result the concentration of hexavalent chromium ions in the plating bath is preferably as low as possible but most preferably less than 0.1 g/l.

Similarly the source of sulfate and/or sulfonate ions can be any soluble source of these anions. Preferably sulfuric acid is used. Other alternatives include alkane sulfonic acid, salts of sulfuric acid or salts of alkane sulfonic acids. The concentration of sulfate and/or sulfonate anions in the plating bath is preferably from 50 to 150 g/l, most preferably from 90 to 110 g/l. The pH of the plating bath is preferably maintained in the range of 3 to 4.

The source of manganese ions can be any soluble manganese containing salt. It is preferable to use manganese sulfate. However, other salts such as manganese chloride, manganese sulfonate or manganese carbonate can also be used. Preferably the concentration of manganese ions in the plating bath is from 0,01 to 0.7 g/l, most preferably from 0.02 to 0.3 g/l.

As noted, the anodes used should be insoluble in the plating bath. In this regard, insoluble anodes are anodes which do not dissolve or are substantially insoluble in the matrix of the plating bath. Examples of suitable insoluble anodes include lead, lead alloy, platinized titanium anodes, or metal anodes comprising surface coating comprising iridium oxide, ruthenium oxide or mixed iridium/tantalum oxide. Preferably the anodes are metal anodes comprising a surface coating comprising iridium oxide, ruthenium oxide or mixed iridium/tantalum oxide. The metal substrate of the iridium oxide/ruthenium oxide or mixed iridium/tantalum oxide coated anodes can be any bath insoluble metal such as titanium, tantalum, niobium, zirconium, molybdenum or tungsten. Preferably titanium is used. These preferred anodes are well known and are described in U.S. Pat. No. 5,560,815, the teaching of which is incorporated herein by reference in their entirety.

Generally, the plating bath is operated at temperatures ranging from 55 to 65° C. The pH should preferably be from 3 to 4. The cathode current density should generally range from 2 to 10 Amps per square decimeter.

If platinized titanium or lead (alloy) anodes are used, the concentration of manganese ions in the plating bath may need to be increased into the higher end of the recommended range. In this case, manganese ion concentrations of from 0.6 to 0.7 g/l are recommended.

Other additives useful in the plating bath of the invention include carboxylic acid anions such as formate, oxalate, malate, acetate and boric acid.

EXAMPLE I

In order to test the effectiveness of the invention, we used an iridium oxide coated tantalum anode which had been used to the end of its effective life and was producing substantial amounts of hexavalent chromium. This was introduced to a cell equipped with a cation exchange membrane. Both sides of the cell were filled with the trivalent chromium plating electrolyte. The purpose of the cell was to isolate the anode and cathode reactions so that any hexavalent chromium produced at the anode could not be reduced at the cathode. Thus we considered that this would represent a "worst case" scenario.

FIG. 1 shows the results we obtained using a trivalent chromium electrolyte containing:

| | |
|---|---|
| 7 g/l | Chromium metal added as basic chromium sulfate |
| 160 g/l | Sodium sulfate |
| 75 g/l | Boric acid |
| 10 g/l | Malic acid |

The cell was operated at 60 degrees centigrade using an anode current density of 5 amps/square decimeter and a pH of 3.4. The volume of the anolyte was 350 ml.

It can be seen from this figure that in the comparative example (no manganese added), the hexavalent chromium increased very rapidly reaching a value of 245 ppm after an electrolysis time of 60 minutes. With 100 ppm of manganese sulfate added (equivalent to 30 ppm manganese), the amount of hexavalent chromium produced still continued to increase reaching a value of 130 ppm after 60 minutes. Even at this manganese concentration, the hexavalent chromium generation rate was markedly reduced when compared to the comparative example. The effect of higher concentrations of manganese sulfate (0.25 g/l and 0.5 g/l respectively) are also demonstrated. These examples illustrate that at 0.5 g/l manganese sulfate (equivalent to 150 ppm manganese), after 80 minutes continuous electrolysis, no further increase of hexavalent chromium was determined. This indicates that after this period, the anode was substantially inhibited from producing hexavalent chromium.

The invention claimed is:

1. A process for plating chromium metal onto a substrate, said process comprising electroplating the substrate with a plating solution comprising:

(a) trivalent chromium ions;

(b) sulphate or sulfonate ions; and (c) manganese ions;

wherein the substrate is made a cathode and insoluble anodes are used and wherein the concentration of manganese ions in the plating solution is from 0.01 to 0.7 g/l and wherein, during electroplating, manganese dioxide forms on the insoluble anodes.

2. A process according to claim 1 wherein the insoluble anodes are selected from the group consisting of (i) platinized titanium anodes, (ii) lead or lead alloy anodes, and (iii) metal anodes coated with a surface coating comprising iridium oxide, ruthenium oxide or a mixture of iridium and tantalum oxides.

3. A process according to claim 1 wherein the insoluble anodes comprise metal anodes coated with a surface coating comprising a mixture of iridium and tantalum oxides.

4. A process according to claim 3 wherein the concentration of manganese ions is from 0.05 to 0.5 g/l.

5. A process according to claim 1 wherein the insoluble anodes comprise metal anodes coated with a surface coating comprising iridium oxide or ruthenium oxide.

* * * * *